US005204907A

United States Patent [19]

Staple et al.

[11] Patent Number: 5,204,907

[45] Date of Patent: Apr. 20, 1993

[54] NOISE CANCELLING MICROPHONE AND BOOT MOUNTING ARRANGEMENT

[75] Inventors: Bruce W. Staple; Bakulesh B. Patel, both of Coral Springs; David H. Karl, Tamarac, all of Fla.

[73] Assignee: Motorola, Inc., Schaumburg, Ill.

[21] Appl. No.: 706,459

[22] Filed: May 28, 1991

[51] Int. Cl.[5] ..... H04R 1/02; H04R 25/00

[52] U.S. Cl. ..... 381/91; 381/168; 381/169

[58] Field of Search ..... 381/156, 158, 168, 169, 381/155; 181/158, 91

[56] References Cited

U.S. PATENT DOCUMENTS

| | | | |
|---|---|---|---|
| 2,702,318 | 2/1955 | Dvorsky . | |
| 3,638,052 | 1/1972 | Massa | 381/173 |
| 3,835,263 | 9/1974 | Killion | 381/169 |
| 4,174,469 | 11/1979 | Kusuyama | 381/155 |
| 4,412,106 | 10/1983 | Pavel | 381/119 |
| 4,463,222 | 7/1984 | Poradowski | 381/155 |
| 4,789,044 | 12/1988 | Akino | 381/155 |
| 4,817,164 | 3/1989 | Bertignoll et al. | 381/169 |
| 4,850,016 | 7/1989 | Groves et al. . | |
| 5,027,394 | 6/1991 | Ono et al. | 379/433 |

FOREIGN PATENT DOCUMENTS 999236 7/1965 United Kingdom ..... 381/169

OTHER PUBLICATIONS

Motorola, Inc., DYNA T.A.C., Cellular Portable Telephone, Instruction Manual No. 69P81046E60-B, Oct. 15, 1985.

*Primary Examiner*—James L. Dwyer
*Assistant Examiner*—Jack Chiang
*Attorney, Agent, or Firm*—Pablo Meles; Lesley A. Rhyne

[57] ABSTRACT

An apparatus for mounting a noise cancelling microphone (34) within a communication device comprises a housing having a front portion (36), a back portion and side portions (40). The front portion (36) and one of the side portions (40) have apertures (38 and 40). Within the housing lies a receptacle (32 or 50 or 100) for retaining a microphone or transducer (34). The receptacle is arranged and constructed to form a chamber (32) between the apertures (38 and 40) in the front portion (36) and the side portion (40) of the housing.

13 Claims, 3 Drawing Sheets

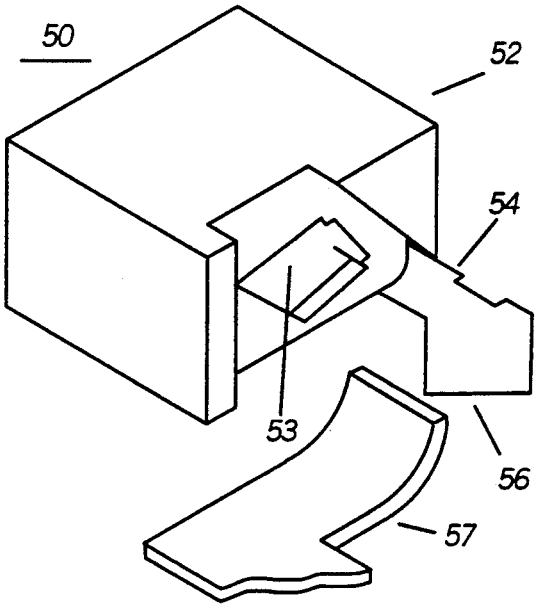
FIG.3
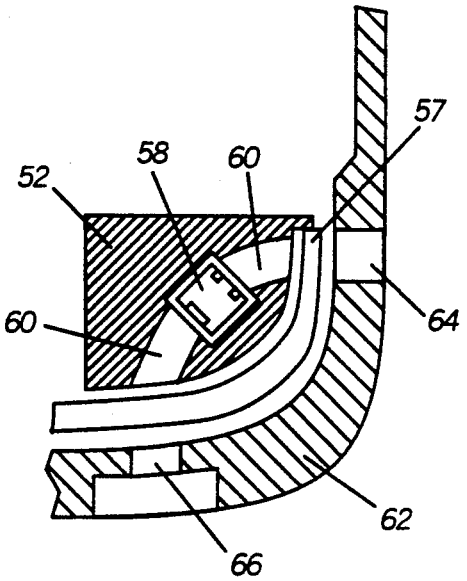
FIG.4
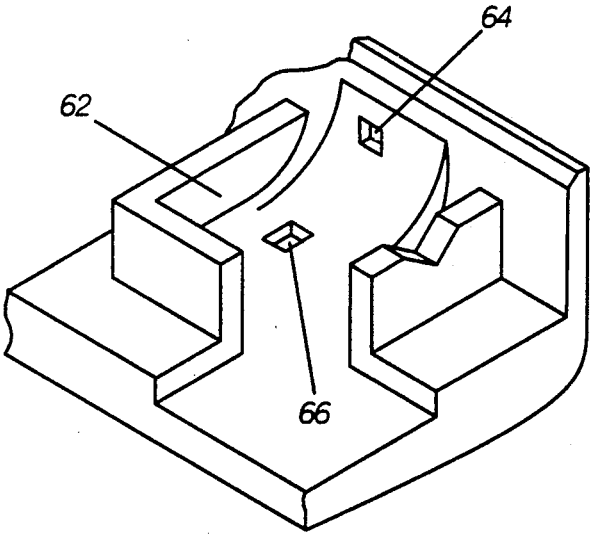
FIG.5
FIG.6
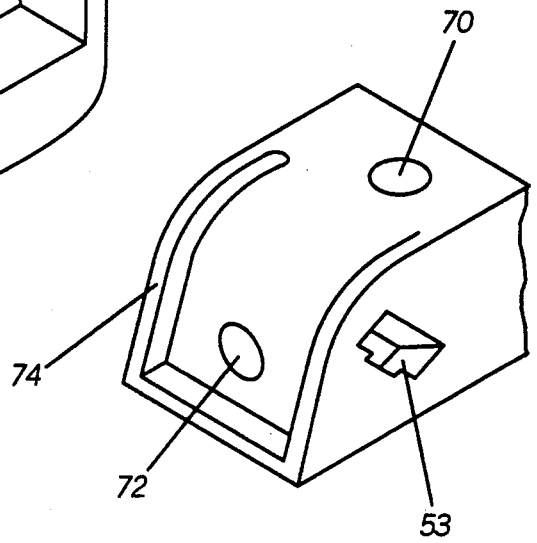

NOISE CANCELLING MICROPHONE AND BOOT MOUNTING ARRANGEMENT

TECHNICAL FIELD

This invention relates to noise cancelling microphones, and more particularly to a microphone and boot mounting arrangement within a housing for communication products.

BACKGROUND OF THE INVENTION

A mounting arrangement is typically used in a communications product to orient or position a transducer or microphone within a housing. The mounting arrangement orients the microphone near an opening or apertures in the housing to provide the microphone access to a sound medium external to the housing. Optimal sound characteristics and reproduction of natural sound for a communication device would require acoustic and environmental sealing and an arrangement where a flat frequency response to a near field sound source is achieved. Typically, noise cancelling microphones have access to two ports and therefore are not noted for their environmental sealing ability. If a pressure differential microphone cartridge is used, the frequency response would vary with the acoustic loading on the two ports. Therefore, a balanced chamber would be desirable. In a radio housing which is substantially thicker than the thickness of the microphone cartridge, the microphone is mounted near the front grille to maintain high sensitivity to speech signals. The back port of the microphone is connected via a long channel in the radio housing as shown in FIG. 1B. Thus, this type of arrangement creates undesirable resonances in the frequency response of the microphone.

Furthermore, mounted microphones may use treated felt that secures to the housing or boot with an adhesive. Finally, silicone or other sealing material is typically used to maintain a weatherproof seal where the flexible lead wires exit the boot and microphone assembly. The selective application of adhesive to felt and silicone to the boot assembly becomes time consuming and awkward. These problems along with the problem of finding an efficient interference fit between the housing and the microphone/boot assembly leads to slow assembly time, increased cost, and poor quality. The present invention overcomes the problems described above while maintaining the acoustic and environmental sealing properties needed for a high quality noise cancelling microphone.

SUMMARY OF THE INVENTION

An apparatus for mounting a noise cancelling microphone within a communication device comprises a housing having a front portion, a back portion and side portions. The front portion and one of the side portions have apertures. Within the housing lies a receptacle for retaining a microphone or transducer. The receptacle is arranged and constructed to form a chamber between the apertures in the front portion and the side portion of the housing.

In another aspect of the invention, a boot for mounting a noise cancelling microphone in a communication device comprises a first portion having a trough shaped portion and a second portion for mating with the first portion so as to form a chamber from the trough shaped portion and the second portion when mated. Additionally, a hinge is integrally formed between the first portion and the second portion.

BRIEF DESCRIPTION OF THE DRAWINGS

FIG. 3 is a perspective view of a boot in accordance with the present invention.

FIG. 4 is a cut view of a microphone and boot mounting arrangement in accordance with the present invention.

FIG. 5 is a partial perspective view of the housing for receiving the boot in accordance with the present invention.

FIG. 6 is a another perspective view of the bottom of the boot in FIG. 3.

DESCRIPTION OF THE PREFERRED EMBODIMENT

Figure 1A:
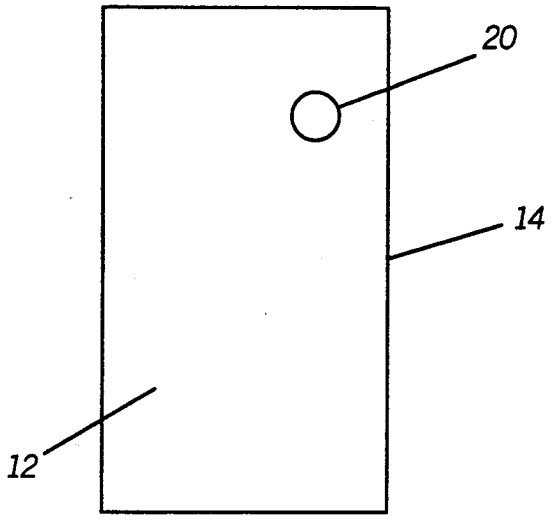
FIG.1A (PRIOR ART)
FIG. 1A is a front planar view of a radio having a microphone port in the front face the radio.
Figure 1B:
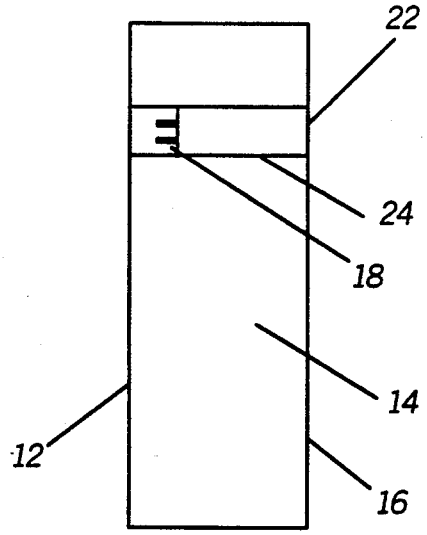
FIG.1B (PRIOR ART)
FIG. 1B is a side planar view of the radio of FIG. 1A.

Referring to FIGS. 1A and 1B, there is shown a conventional noise cancelling microphone mounting method wherein a radio 10 has a front microphone port 20 on a front side 12 of the radio and a back microphone port 22 on a back side 16 of the radio. Instead of externally porting a microphone 18 through the side 14, the microphone is ported through the back port 22 via a channel 24. In this arrangement, the ports and their corresponding surfaces are at 90° from each other.

Figure 2:
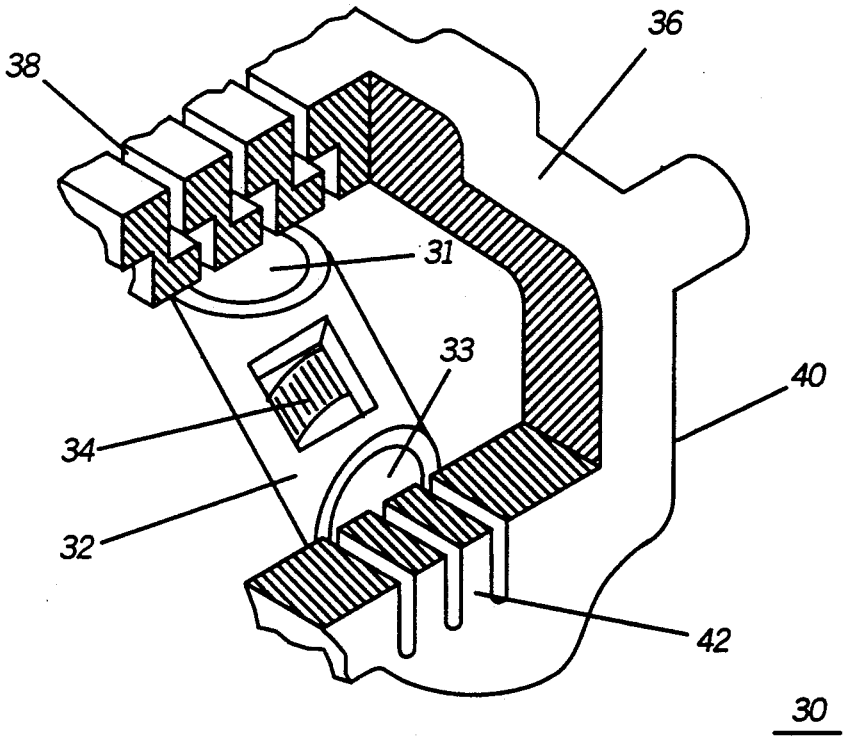
FIG. 2 is a cut perspective view of a microphone mounting arrangement in accordance with the present invention.

Referring to FIG. 2, a partial cut perspective view of a noise cancelling microphone boot arrangement in accordance with the present invention is shown. The microphone or transducer 34 resides in a substantially tubular chamber 32, preferably in the middle of the chamber to provide balanced chambers at both ends to optimize the performance of the noise cancelling microphone transducer. The microphone or transducer 34 is preferably a unidirectional microphone cartridge or pressure differential microphone. As shown, the microphone 34 and chamber 32 lie in substantially a 45° angle from the housing covers. The housing covers include the front cover 36 having a front aperture or port 38 and a side cover 40 having a side aperture of port 42. The Chamber ports 31 and 33 are arranged and constructed to lie substantially flush against the front ports 38 and side ports 42 of the housing cover respectively. The openings in the housing cover (38 and 42) are at right angles from each other rather than the 180° arrangement shown in FIG. 1B. The arrangement in FIG. 2 provides a flat frequency response. Polar plots show that this arrangement attenuates noise in the back or side of the radio while very little attenuation occurs in the front side of the radio.

Referring to FIG. 3, there is shown a perspective view of a boot 50, preferably made of an elastomeric material. The boot 50 comprises of a substantially cubic main portion 52 and an acoustic seal flap 56 which folds in place at assembly and seals the electrical circuits openings of the microphone. The main portion 52 and the flap 56 are coupled together by a living hinge 54. Referring to FIGS. 4, 5, and 6, the boot 50 is press fit into a housing 62. Preferably, a piece of felt 57 is wedged between the boot 50 and the housing 62. The felt 57 is preferably treated to resist driving rain from intruding into the chamber 60. The transducer or microphone 58 is wedged in the area 53 substantially in the middle of the chamber 60. The boot 50 has external ports 70 and 72 which are placed adjacent to the openings 64 and 66 respectively in the housing 62 when the boot is press fit into the housing. Additionally, the boot 50 may include sound chamber isolation ribs 74 on the bottom portion of the boot as shown in FIG. 6.

Figure 7:
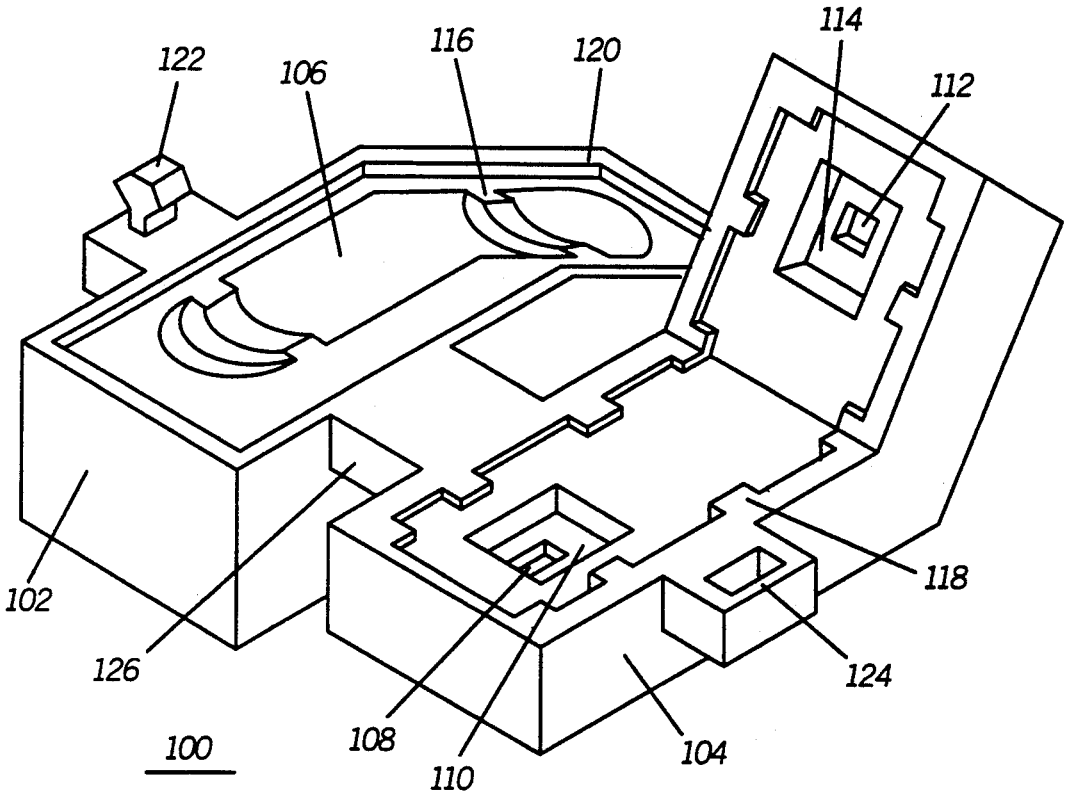
FIG. 7 is a perspective view of an alternative embodiment of a boot in accordance with the present invention.
Figure 8:
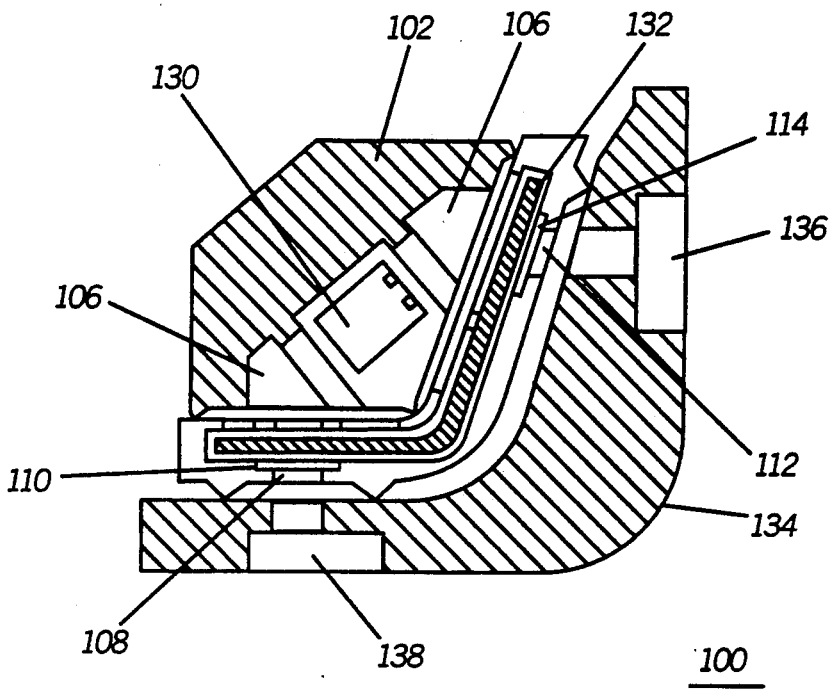
FIG. 8 is a side cut view of the boot of FIG. 7 and a microphone mounted in a housing in accordance with the present invention.

Referring to FIG. 7, a perspective view of an alternative boot 100 in accordance with the present invention is shown. The boot 100 comprises a first member 102 having a substantially trough shaped recess 106 wherein a chamber is formed when the first member 102 is mated with a second member 104. The first and second members are coupled together by an integrally formed living hinge 126. The first and second members (102 and 104 can be locked together using a locking feature having a male portions 122 and a female portion 124. Of course, other means of retaining the portions together can be used. Preferably, the recess 106 further includes cartridge locating ribs 116 for accurate placement of the microphone cartridge 130 shown in FIG. 8. The first portion also preferably includes sound isolation ribs 120 which provides an improved acoustic seal. In the second member 104, felt locking or retaining features 118 are provided to retain felt with out using any type of adhesive. A portion of the retaining features 118 also serves as sound isolation ribs. The felt 132 remains wedged within the boot once the boot is locked together and press fitted against the housing 134. The second member 104 also includes primary sound chamber 110 and a primary sound port 108 as well as a secondary sound chamber 114 and a secondary sound port 112 which allows the microphone 130 to receive signals from both ends. The boot 100 and the formed chamber 106 is press fit against the housing 134. The primary sound chamber and primary sound port is press fit adjacent to the aperture or port 138 in the housing 134. Likewise, the secondary chamber and secondary sound port is press fit adjacent the aperture or port 136.

We claim as our invention:

1. An apparatus for mounting a noise cancelling microphone within a communication device, comprising:

a housing having a front portion, a back portion and side portions, said front portion and one of said side portions having apertures;

a microphone;

a boot having a first portion, a second portion, and a living hinge integrally attaching said first portion to said second portion for retaining said microphone within said housing, said boot being arranged and constructed to form a substantially balanced chamber between said aperture in said front portion and said aperture of said side portion of said housing.

2. The apparatus of claim 1, wherein said boot further comprises microphone locating ribs for accurate placement of said microphone.

3. The boot of claim 1, wherein said boot further comprises sound isolation ribs about a periphery of said first portion to provide a better acoustic seal.

4. The boot of claim 1, wherein said boot further comprises felt locking ribs for retaining the felt within the boot.

5. The boot of claim 4, wherein said felt locking ribs further serve as sound isolation ribs about a periphery of said second portion to provide a better acoustic seal.

6. The boot of claim 1, wherein felt is wedged between the boot and the housing to provide a better environmental seal.

7. A boot for mounting a noise cancelling microphone in a communication device, comprising:

a first portion having a trough shaped portion;

a second portion having ports at different planes, and second portion for mating with said first portion so as to form a chamber from the trough shaped portion and said second portion when mated;

a noise cancelling microphone located substantially in middle of said chamber forming a balanced chamber;

a hinge integrally formed between said first portion and said second portion, allowing for placement of said noise cancelling microphone in the formed chamber of the boot.

8. The boot of claim 7, wherein said boot further comprises microphone locating ribs for accurate placement of said microphone.

9. The boot of claim 7, wherein said boot further comprises sound isolation ribs about a periphery of said first portion to provide a better acoustic seal.

10. The boot of claim 7, wherein felt is wedged between the boot and a housing for the communication device to provide a better environmental seal.

11. The boot of claim 7, wherein felt is wedged within the boot to provide a better environmental seal.

12. The boot of claim 11, wherein said boot further comprises felt locking ribs for retaining the felt.

13. The boot of claim 12, wherein said felt locking ribs further serve as sound isolation ribs about a periphery of said second portion to provide a better acoustic seal.

* * * * *